US005157200A

United States Patent [19]

Mikkinen et al.

[11] Patent Number: 5,157,200

[45] Date of Patent: Oct. 20, 1992

[54] PROCESS FOR THE FRACTIONATION OF A GASEOUS MIXTURE CONTAINING HYDROGEN LIGHT ALIPHATIC HYDROCARBONS AND LIGHT AROMATIC HYDROCARBONS

[75] Inventors: Ari Mikkinen, Saint Nom La Breteche; Serge Mouratoff, Paris; Larry Mank, Orgeval, all of France

[73] Assignee: Institut Francais Du Petrole, Rueil-Malmaison, France

[21] Appl. No.: 672,682

[22] Filed: Mar. 20, 1991

[30] Foreign Application Priority Data

Mar. 20, 1990 [FR] France ..... 90 03652

[51] Int. Cl.[5] ..... C07C 7/00; C07C 7/144; B01D 59/10; B01D 3/34

[52] U.S. Cl. ..... 585/803; 585/804; 585/818; 55/16; 55/23; 203/70

[58] Field of Search ..... 585/803, 804, 818; 55/16, 23; 203/70

[56] References Cited

U.S. PATENT DOCUMENTS 4,548,619 10/1985 Steacy ..... 585/818

*Primary Examiner*—Anthony McFarlane
*Assistant Examiner*—Nhat Phan
*Attorney, Agent, or Firm*—Antonelli, Terry, Stout & Kraus

[57] ABSTRACT

A process for the fractionation of a gaseous mixture containing hydrogen, light aliphatic hydrocarbons and light aromatic hydrocarbons wherein following compression of the mixture and separation of one or more light fractions, a gas is contacted with light aliphatic hydrocarbons and then hydrogen is separated by permeation. A series of distillation steps makes it possible to isolate the aliphatic hydrocarbons and the aromatic hydrocarbons subsequent to the separations.

11 Claims, 1 Drawing Sheet

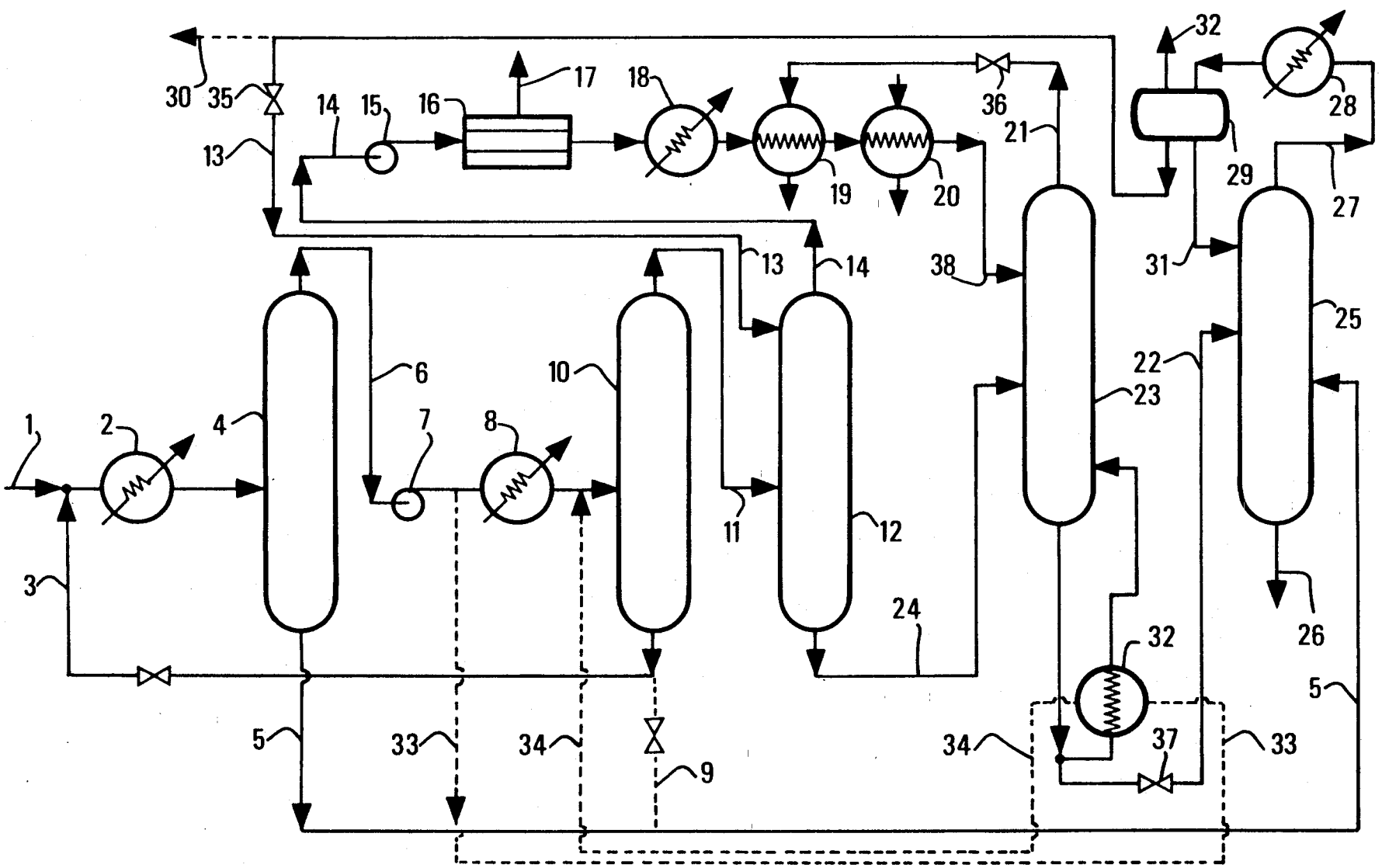
1
2
3
4
5
6
7
8
9
10
11
12
13
14
15
16
17
18
19
20
21
22
23
24
25
26
27
28
29
30
31
32
33
34
35
36
37
38

PROCESS FOR THE FRACTIONATION OF A GASEOUS MIXTURE CONTAINING HYDROGEN LIGHT ALIPHATIC HYDROCARBONS AND LIGHT AROMATIC HYDROCARBONS

BACKGROUND OF THE INVENTION

The invention relates to a process for the fractionation of a gaseous mixture containing hydrogen, light aliphatic hydrocarbons and light aromatic hydrocarbons.

The invention more particularly aims at separately collecting (1) high purity hydrogen and in particular only containing traces of aromatic hydrocarbons, (2) $C_2$–$C_5$ and in particular $C_3$ or $C_3$–$C_4$ aliphatic hydrocarbons, which can at least partly be recycled to a hydrocarbon conversion process, e.g. a dehydrocyclodimerization process, and (3) light aromatic hydrocarbons alone or in mixed form (BTX).

Various processes are known in which the effluent is a mixture of hydrogen, light and in particular $C_1$–$C_5$ aliphatic hydrocarbons and light aromatic hydrocarbons, particularly benzene, toluene and/or xylene or their mixtures (BTX). These processes include catalytic reforming, aromatization, dehydrogenation, dehydrocyclization, steam cracking and dehydrocyclodimerization. More particularly, in the latter process, light olefins or paraffins, e.g. $C_3$ and $C_4$ are converted into light aromatic hydrocarbons in contact with zeolitic catalysts.

The conversion of aliphatic hydrocarbons into aromatic hydrocarbons is e.g. described in U.S. Pat. Nos. 4133743, 4210519, 4233268 and 4172027.

The aromatization of aliphatic hydrocarbons into aromatic hydrocarbons is e.g. described in French patents 2634139 and 2634140.

As a result of these processes and in a conventional manner the hydrogen is separated in a high pressure separator and the hydrocarbons are separated in a series of distillation columns.

The use of perm-selective diaphragms for the separation of hydrogen from hydrocarbons has also been proposed, e.g. in U.S. Pat. Nos. 4180388, 4398926 and 4654047. The use of a perm-selective diaphragm and fractionation columns is described in U.S. Pat. No. 45488619. In the latter patent, the effluent of a dehydrocyclodimerization unit is firstly fractionated, the liquid fraction being distilled to collect the BTX and the gaseous fraction is compressed and then washed by aromatic hydrocarbons or $C_7$–$C_{10}$ paraffinic hydrocarbons having an external origin.

SUMMARY OF THE INVENTION

The present invention relates to a process for the fractionation of a gaseous mixture containing hydrogen, light aliphatic hydrocarbons and light aromatic hydrocarbons, which is economical from the energy standpoint and in particular in which the energy requirements for the fractionation of the product are reduced. It also relates to a process in which the hydrogen obtained is substantially free from aromatic hydrocarbons. It also relates to a process making it possible to use diaphragms which are sensitive to aromatic hydrocarbons, due to the virtual absence thereof in the gas which is subject to permeation. The process of the invention avoids the undesirable crystallization of aromatic hydrocarbons.

In the process of the invention a gaseous mixture and e.g. the gaseous effluent from a hydrocarbon conversion reactor which contains hydrogen, light aliphatic hydrocarbons and light aromatic hydrocarbons is firstly cooled to a temperature permitting the condensation of part of the hydrocarbons. Separation takes place of a first non-condensed, gaseous fraction having a relatively low aromatics content and a first liquid fraction having a relatively low aromatics content and a first liquid fraction having a relatively high aromatics content.

The first gaseous fraction is compressed and cooled, so as to condense at least one second liquid fraction and the latter is separated from a second non-condensed, gaseous fraction. The second gaseous fraction is contacted with a subsequently defined aliphatic hydrocarbon liquid phase in a contact zone, under conditions ensuring both the vaporization of at least part, e.g. at least 50% and preferably 60 to 95% of the aliphatic hydrocarbon liquid phase and the condensation of at least part of the aromatic hydrocarbons of the second gaseous fraction, said condensation being at least partly brought about by the cooling, due to the vaporization of the aliphatic hydrocarbons, and a third gaseous fraction is separated from a third liquid fraction containing aliphatic hydrocarbons and aromatic hydrocarbons. The second and third liquid fractions can also be drawn off in mixed form.

The third gaseous fraction is treated to bring it above the dew point. It is circulated in contact with at least one hydrogen-permeable diaphragm and a gaseous, hydrogen-enriched fraction and a fourth gaseous, hydrogen-depleted fraction are collected. The fourth gaseous fraction is cooled so as to partly condense it and a fifth gaseous, methane-rich fraction is collected, which can constitute a fuel gas, as well as a fourth liquid fraction containing at least one $C_3$ to $C_5$ hydrocarbon.

The first, second, third and fourth liquid fractions undergo distillation, either together or separately, in one or more columns and at the head is collected at least one sixth gaseous fraction containing at least one $C_3$ or $C_5$ hydrocarbon and at the bottom at least one fifth liquid fraction, which constitutes a sought aromatic hydrocarbon fraction. At least part of the hydrocarbons of the sixth gaseous fraction are condensed and fed to the contact zone in order to constitute at least part of the aliphatic hydrocarbon liquid phase.

Preferably, another part of the sixth gaseous fraction is supplied to the hydrocarbon conversion reactor as a recycling flow, at least when one or more $C_3$–$C_5$ hydrocarbons constitute a reagent for said conversion.

The hydrocarbon conversion reactor can e.g. be a $C_2$–$C_5$ and in particular a $C_3$ and/or $C_4$ light hydrocarbon aromatization reactor using a zeolite as the catalyst and in particular a zeolite described in French patents 2634139 or 2634140.

The reactor outlet pressure is e.g. 1.5 to 10 and normally 2 to 5 bars. If the temperature is high, it is lowered to around 10° to 60° C. and preferably 30° to 50° C., so as to condense part of the gaseous effluent of the reactor and collect at least part of the aromatic hydrocarbons. If desired, it is possible to modify the pressure in order to aid the condensation of the aromatic hydrocarbons.

The first gaseous fraction is then compressed e.g. to 15 to 40 bars and preferably 20 to 30 bars and then cooled, in order to bring its temperature to about 0° to 50° C. and preferably 25° to 35° C. At least one second liquid fraction, which contains aromatics is condensed.

This liquid fraction is separated from the second gaseous fraction under the aforementioned pressure. Instead of a single compression stage followed by cooling and fractionation, it is possible to use several compression stages, followed in each case by a partial condensation and a fractionation.

The contacting of the second gaseous fraction with the recycled aliphatic hydrocarbon liquid phase containing at least one $C_3$–$C_5$ and preferably $C_4$–$C_5$ hydrocarbons constitutes an essential point of the invention. The vaporization of at least 50% of the $C_3$–$C_5$ hydrocarbons of this liquid phase leads to a cooling of the second gaseous fraction and the condensation of at least part of the residual aromatic hydrocarbons. The temperature is e.g. between −10° and +40° C. and preferably between 5° and 35° C. At the head, the temperature is between −10° and +30° C. and preferably e.g. 0° to 20° C. At the bottom it is e.g. 5° to 40° C. and preferably 10° to 25° C. The pressure can essentially be that of the second gaseous fraction (after compression of the first gaseous fraction), i.e. 15 to 40 bars and preferably 20 to 30 bars. Expressed by weight, the aliphatic hydrocarbon liquid phase quantity can represent e.g. 5 to 35% and preferably 10 to 25% of the quantity of the second gaseous fraction, but the invention is not limited to particular proportions.

In certain cases, particularly when the second gaseous fraction is very rich in $C_3$–$C_4$, it can be advantageous for the recycled aliphatic hydrocarbon liquid phase to also contain a certain proportion of $C_6$, $C_7$ and/or $C_8$ non-aromatic hydrocarbons.

The resulting gaseous flow is then brought above its dew point, e.g. by heating or by dilution with a dry gas, but preferably by supplementary compression ensuring superheating (an increase of 2 to 7 bars is generally adequate). This is followed by contacting with at least one selective permeation diaphragm in one or more stages. Superheating is preferably such that no condensation occurs during the drawing off of hydrogen in the diaphragm.

With regards to the permeation, reference can be made to one of the aforementioned patents and working preferably takes place in several stages with recompression of the gas between the stages. The permeation diaphragm can be a prior art or commercially available diaphragm and will not be described in detail. The operating conditions are dependent on the diaphragm, e.g. 80° to 150° under 20 to 40 bars with conventional diaphragms. On leaving the permeation stage, the hydrogen-depleted gaseous fraction and which normally contains $C_1$–$C_5$ hydrocarbons undergoes cooling in order to condense a liquid phase containing $C_3$–$C_5$ hydrocarbons. The cooling can in part use relatively cold flows of the process, e.g. the flow of the fifth gaseous fraction and in part liquefied gas flows, e.g. a liquid ethane or propane flow.

The distillation of the liquid fractions (first, second, third and fourth) can be carried out separately or after mixing two or more fractions. It is also possible not to directly distil the second liquid fraction and to supply it to the first fractionation zone for fractionating again mixed with the reactor effluent.

According to a first embodiment, it is possible to distil a mixture of the first liquid fraction and the second liquid fraction, the third and fourth liquid fractions then being separately distilled. It is also possible to distil together the first, second, third and fourth liquid fractions. Other combinations of fractions can also be used.

According to a preferred embodiment, on leaving the contact zone, the third gaseous fraction is compressed before passing into the permeation zone. The compressor can then be in line with the compressors of the preceding stages. An important advantage of this compression and its thermal effect is of placing the gaseous mixture above the dew point of the hydrogen-depleted hydrocarbons.

According to another embodiment, the compressor for the third gaseous fraction receives energy and preferably mechanical energy produced by an expander located on the circuit of the fifth gaseous fraction. In this case, use is preferably made respectively of a turbocompressor and a turboexpander. According to a variant, there is no compression stage for the third gaseous fraction and instead heating alone occurs and the turboexpander transmits its energy to one or more compression stages of the first gaseous fraction.

According to another embodiment the sixth gaseous fraction undergoes a partial condensation. At least part of the butane and pentane-rich condensate is used as the contacting liquid with the second gaseous fraction, the remainder being returned as reflux to the column, where separation takes place of said sixth gaseous fraction from said fifth liquid fraction. The non-condensed part constituting a seventh propane-rich gaseous fraction can be supplied to the dehydrocyclodimerization reactor.

BRIEF DESCRIPTION OF THE DRAWINGS

The accompanying SOLE FIGURE of drawings illustrates a non-limitative embodiment of the invention.

DETAILED DESCRIPTION OF THE INVENTION

The gaseous effluent (1) from a $C_3$–$C_9$ paraffin aromatization unit available under 1.5 to 5 bars is cooled at about 30° to 40° C. in the exchanger (2) and optionally receives the flow (3). In the exchanger (2), part of the gaseous phase is condensed and in the round-bottomed flask (4) separation takes place of a liquid phase (5) and a gaseous phase (6). The latter undergoes one or more compression stages (7) followed by cooling (8). The liquids collected can be supplied by the line (9) to the distillation system or by line (3) to the intake for the installation. A gaseous flow (11) leaves the round-bottomed flask (10) and is contacted in the round-bottomed flask (12) with a $C_3$–$C_5$ liquid flow from line (13). The gaseous phase (14) undergoes compression with superheating in the compressor (15) and then passes into the permeation unit (16).

Purified hydrogen passes out through line (17). The residual gas (38) undergoes cooling, e.g. by cold water (18), by a cold gas flow (19-21) and by liquid propane (20) at low temperature, e.g. −30° to −40° C. A partial liquefaction occurs and at the head of the column (23) is collected a methane-rich gas by line (21) and a liquid flow (22) at the bottom of the column (23). In the present case, the liquid flow (24) drawn off from the contactor (12) is also supplied to the column (23), but preferably at a lower point than that used for admitting the flow from the permeation unit. The liquid (22) is refractionated in the column (25) which, in the present embodiment, also receives the liquid from the line (5). The latter is preferably introduced at a relatively low point of the column (25) and which is lower than the introduction level for the liquid (22). An aromatic hydrocarbon-rich mixture is collected by the line (26). At the head, the $C_3$–$C_5$ hydrocarbon-rich vapours (27) are cooled and partly condensed (28). In the separator (29) collection takes place of an e.g. $C_3$–$C_5$ or $C_4$–$C_5$ liquid phase, which is partly supplied to the contactor (12) by the line (13). It is also possible to recycle part of it to the aromatization reactor by the line (30). It is possible to ensure a reflux by the line (31). If a gaseous phase (32) remains, it can be supplied to the dehydrocyclodimerization reactor.

According to a variant, the separator (10) is not used and the flow which has traversed the cooler (8) is directly supplied to the bottom of the contactor (12). In this case, the second and third liquid fractions pass out in mixed form by the line (24). The lines (9 and 3) are not then used.

According to another variant, the heat given off by the compression in a compression stage (7) is used for heating the reboiler of a distillation column (23), the gas (33) leaving the compressor (7) then passing through an exchanger in the reboiler (32) of said column and is then supplied (34) to the round-bottomed flask (10) and to the contactor (12). The cooler (8) can then be eliminated (35, 36, 37) being relief valves.

For example, treatment takes place of 7724 parts per hour of a charge containing (by weight) 2.4% hydrogen, 11.3% $C_1$ and $C_2$, 18.8% of $C_3$–$C_5$, 17.5% of $C_6$+aliphatics and 50% BTX. After separation in (4), compression in (7) to 22 bars and cooling to 35° C. in (8), the column (12) directly receives (the separator 10 not being used) 2922 parts by weight per hour of a 6.3% by weight BTX flow. By the line (13) are supplied 628 parts by weight per hour of the $C_3/C_4$ fraction. The head temperature is 17° C. and the bottom temperature 34° C. The head flow only contains 0.4% by weight BTX, the BTX concentration in the bottom flow being 26% by weight. Approximately 30% of the $C_3/C_4$ pass out at the bottom and 70% at the head. After overcompression of 5 bars (P total=27 bars), which increases the degree of superheating of the gaseous mixture by 15%, more than 90% of the hydrogen in contact with the diaphragms is removed. After distillation of the flows (5, 24, 38) it is found that 198 parts by weight per hour of hydrogen have been collected with a purity of 90%, 603 parts by weight per hour of fuel gas, 2146 parts by weight per hour of the $C_3/C_4$ fraction (whereas 629 parts by weight per hour are recycled) and 5406 parts by weight per hour of BTX-rich fraction. The $C_3$–$C_4$ recovery level exceeds 90%.

We claim:

1. A process for the fractionation of a gaseous mixture containing hydrogen, light aliphatic hydrocarbons and light aromatic hydrocarbons, which comprises effecting the following stages:

a) cooling said mixture to condense a part of the hydrocarbons to form a first condensed aromatics enriched liquid fraction and separating a first non-condensed, aromatics-depleted gaseous fraction and the first condensed aromatics-enriched liquid fraction;

b) raising pressure of the first non-condensed aromatics-depleted gaseous fraction and then cooling said first gaseous fraction to form a second liquid fraction and a second non-condensed gaseous fraction and separating the second liquid fraction and the second non-condensed gaseous fraction;

c) contacting the second gaseous fraction with an aliphatic hydrocarbon liquid phase containing at least one hydrocarbon having 3 to 5 carbon atoms, in a contact zone, under conditions ensuring vaporization of at least one $C_3$–$C_5$ fraction of the aliphatic hydrocarbon liquid phase and condensation of at least part of the aromatic hydrocarbons of the second gaseous fraction and separating a third gaseous fraction from a third liquid fraction;

d) treating the third gaseous fraction to bring the third gaseous fraction to above its dew point and circulating the third gaseous fraction in contact with at least one hydrogen-permeable diaphragm and collecting a hydrogen-enriched gaseous fraction and a fourth hydrogen-depleted gaseous fraction;

e) cooling the fourth gaseous fraction to partly condense the fourth gaseous fraction and collecting a fifth methane-enriched gaseous fraction and a fourth liquid fraction containing at least one hydrocarbon having 3 to 5 carbon atoms;

f) effecting distillation together or separately of the first, second, third and fourth liquid fractions in a distillation system and collecting at least one sixth gaseous fraction, containing at least one $C_3$–$C_5$ hydrocarbon and at least one fifth liquid fraction containing aromatic hydrocarbons; and g) condensing at least part of the hydrocarbons of the sixth gaseous fraction and supplying the condensed hydrocarbons to a contact zone of stage c) in order to comprise at least a part of the aliphatic hydrocarbon liquid phase.

2. A process according to claim 1, wherein the mixture to be fractionated is a product of an aliphatic hydrocarbon conversion reactor; said process further comprises supplying a part of the sixth gaseous fraction as a reagent to said aliphatic hydrocarbon conversion reactor.

3. A process according to claim 1, wherein stage a) is performed at 10° to 60° C. under 1.5 to 10 bars pressure; separation in stage b) is carried out at 0° to 50° C. under 15 to 40 bars pressure and stage c) is carried out at −10° to +40° C. under 15 to 40 bars pressure.

4. A process according to claim 3, wherein stage a) is carried out at 30° to 50° C. under 1.5 to 10 bars pressure, separation in stage b) is carried out at 25° to 35° C. under 20 to 30 bars pressure; stage c) is carried out at 5° to 35° C. under 20 to 30 bars pressure and stage d) is carried out at 50° to 150° C. under 20 to 40 bars pressure.

5. A process according to claim 1, wherein a temperature rise in stage d) is obtained by compression of the third gaseous fraction.

6. A process according to claim 1, which further comprises mixing the second and third liquid fractions and thereafter distilling the resulting admixture.

7. A process according to claim 1, which further comprises compressing the third gaseous fraction by a mechanical compression means before contacting said third gaseous fraction with the diaphragm; expanding the fifth gaseous fraction in a mechanical expansion means and transmitting at least a part of mechanical energy produced by the expansion to the mechanical compression means compressing the third gaseous fraction.

8. A process according to claim 2, which further comprises effecting a partial condensation of the sixth gaseous fraction; contacting at least a part of the resulting condensate with the second gaseous fraction; and supplying at least part of a non-condensed fraction of the sixth gaseous fraction to the hydrocarbon conversion reactor.

9. A process according to claim 1, wherein the cooling in stage b) is carried out by circulating the first compressed gaseous fraction in contact with at least one of the liquid fractions in the distillation system of stage f).

10. A process according to claim 1, wherein in stage c), 60 to 95% of the aliphatic hydrocarbons of the aliphatic hydrocarbon liquid phase are vaporized.

11. A process according to claim 1, wherein the aliphatic hydrocarbon liquid phase also contains at least one $C_6$–$C_8$ non-aromatic hydrocarbon.

* * * * *